US006313573B1

(12) United States Patent
Moon et al.

(10) Patent No.: US 6,313,573 B1
(45) Date of Patent: Nov. 6, 2001

(54) SHADOW MASK FOR CATHODE RAY TUBE AND METHOD OF MANUFACTURING SAME

(75) Inventors: Sung-hwan Moon; Dong-hee Han, both of Kyungki-do; Seung-kwon Han, Seoul, all of (KR)

(73) Assignee: Samsung Display Devices Co., LTD, Kyungki-do (KR)

( * ) Notice: Subject to any disclaimer, the term of this patent is extended or adjusted under 35 U.S.C. 154(b) by 0 days.

(21) Appl. No.: 09/234,925

(22) Filed: Jan. 21, 1999

(30) Foreign Application Priority Data

Jan. 22, 1998 (KR) ..... 98-1852

(51) Int. Cl.[7] ..... H01J 29/80
(52) U.S. Cl. ..... 313/402; 445/47
(58) Field of Search ..... 313/402–408, 313/479; 445/47

(56) References Cited

U.S. PATENT DOCUMENTS 4,210,843 * 7/1980 Avadani ..... 313/403
4,859,901 * 8/1989 Thompson-Russell ..... 313/403
4,942,333 * 7/1990 Knox ..... 313/402
4,964,828 * 10/1990 Patt et al. ..... 313/402
5,451,833 * 9/1995 Tong ..... 313/402
5,928,047 * 7/1999 Ishibashi et al. ..... 445/47

* cited by examiner

*Primary Examiner*—Nimeshkumar D. Patel
*Assistant Examiner*—Mariceli Santiago
(74) *Attorney, Agent, or Firm*—Christie, Parker & Hale, LLP

(57) ABSTRACT

A shadow mask includes an aperture portion having a plurality of apertures formed therein, the aperture portion being formed over a predetermined area in a center of the shadow mask; and a non-aperture portion defining a periphery of the shadow mask and formed adjacent to the aperture portion. Only the aperture portion is selectively heat-treated to result in a tensile strength of the aperture portion being 1.2 to 3 times greater than that of the non-aperture portion, and the modulus of elasticity of the aperture portion being 1.5 to 3 times greater than that of the non-aperture portion. The method includes the steps of selectively performing a heat-treating process on only the aperture portion of the shadow mask by mounting a separating cover on the non-aperture portion, the separating cover preventing contact of the non-aperture portion with the gaseous atmosphere present during the heat treating process. The shadow mask is then press-formed.

1 Claim, 3 Drawing Sheets

SHADOW MASK FOR CATHODE RAY TUBE AND METHOD OF MANUFACTURING SAME

CROSS-REFERENCE TO RELATED APPLICATION

This application claims priority of Korean Patent Application No. 98-1852, filed Jan. 22, 1998.

FIELD OF THE INVENTION

The present invention relates to a shadow mask for a cathode ray tube (CRT) and a method of manufacturing the same. More particularly, the present invention relates to a shadow mask having improved tensile strength, thereby preventing what is called a spring back phenomenon.

BACKGROUND OF THE INVENTION

A conventional CRT comprises an evacuated envelope having a viewing screen coated with an array of phosphor elements of three different emission colors arranged in a cyclic order, means for producing three convergent electron beams directed towards the screen and a color selection structure or shadow mask comprising a thin multi-apertured metal sheet precisely disposed between the screen and the beam-producing means. The shadow mask shadows the screen and the differences in convergence angles permit the transmitted portions of each beam to selectively excite phosphor elements of the desired emission color.

The conventional CRT shadow mask is typically manufactured by first coating a photoresist on a thin metal plate made of Invar or aluminum-killed steel. The plate is then exposed to light, and developed and etched to form a plurality of holes therein. Thereafter, the plate formed with the holes is annealed using a heat treating process in a hydrogen atmosphere at a high temperature, thereby removing residual stress and providing softness to the plate. The plate is then formed into a predetermined mask shape by the use of a press, after which the plate is cleaned to remove all contaminants from its surface such as fingerprints, dust and other foreign substances. Finally, a blackening process is performed on the shaped plate to prevent doming of the same, thereby completing the manufacture of the shadow mask.

The shadow mask acts as a bridge between electron beams emitted from three electron guns (means for producing three convergent electron beams) and red, green and blue phosphor pixels formed on the screen because it ensures that the electron beams land on the correct phosphor pixels. Accordingly, any deviation of the shadow mask from its original position acts to mis-direct the electron beams to excite unintended phosphor pixels.

The shadow mask can be moved away from its originally-set position in the CRT if it receives external shock or vibrations such as by the loud audio from speakers in the TV set. As the resut electron beams passing through moved shadow mask will land on the wrong phosphor pixel causing deteriorated color purity. This will be described in more detail hereinbelow.

FIG. 1 shows a partial sectional view of a conventional CRT. It shows a shadow mask 6 mounted to a side wall of the panel 1. More specifically a mask frame 5 joined to a periphery of the shadow mask 6 is coupled to a spring 4, which is in turn connected to a stud pin 3 protruding from the side wall of the panel 1. When the CRT receives a substantial external shock or vibrations, the shadow mask 6 is shaken and moves away from its initial position to a deviated position 7. As the result the electron beams 10 emitted from the electron gun 11 will pass through an unintended aperture of the shadow mask 6 resulting in the excitation of the wrong phosphor pixel. This is perceived as shaking of a displayed picture and thus causes a reduction in color purity and other picture quality problems.

Furthermore, in the case where the CRT receives an extreme shock, such as when it is dropped, it is possible for the shadow mask 6 to be deformed. An example of this is shown in FIG. 2 in which a deformed area 12 is illustrated. Needless to say, spurious colors would appear.

In an attempt to solve the above problem, the mask was heat-treated to improve its tensile strength and softness. However, since the heat-treating of a shadow mask increases its modulus of elasticity in the skirt portion of the shadow mask, an angle of the bend in the skirt portion made while press-forming the metal plate used to make the shadow mask is not the intended $\theta$ degrees, but rather a $\theta+\Delta\theta$ degrees as a result of the spring back phenomenon of the skirt portion.

SUMMARY OF THE INVENTION

The present invention has been made in an effort to solve the above problems.

It is an object of the present invention to provide a shadow mask for a cathode ray tube (CRT) and a method of manufacturing the same in which only an aperture portion of the shadow mask is heat-treated to increase its tensile strength and modulus of elasticity, thereby preventing the occurrence of the spring back phenomenon in a skirt portion of the shadow mask.

To achieve the above object, the present invention provides a shadow mask for a CRT and a method of manufacturing the same. The shadow mask includes an aperture portion having a plurality of apertures formed therein, the aperture portion being formed over a predetermined area in the shadow mask; and a non-aperture portion, formed adjacent to the aperture portion, defining the periphery of the shadow mask. Only the aperture portion is selectively heat-treated so that the tensile strength of the aperture portion is 1.2 to 3 times greater than that of the non-aperture portion, and the modulus of elasticity of the aperture portion is 1.5 to 3 times greater than that of the non-aperture portion.

According to a feature of the present invention, the selective heat-treating of the aperture portion is performed in a gaseous atmosphere including at least one gas selected from the group consisting of RX, propane, ammonia, $B_2H_6$ and $BCl_3$.

According to another feature of the present invention, the shadow mask is made of a material having a low thermal expansion rate, preferably of aluminum-killed (AK) steel or Invar.

The method includes the steps of selectively performing a heat-treating process on only the aperture portion of the shadow mask by mounting a separating cover on the non-aperture portion, the separating cover preventing contact of the non-aperture portion with the gaseous atmosphere present during the heat-treating process; and press forming the shadow mask.

According to a feature of the present invention, the heat-treating process is performed in a gaseous atmosphere including at least one gas selected from the group consisting of RX, propane, ammonia, $B_2H_6$ and $BCl_3$.

According to another feature of the present invention, the shadow mask is made of a material having a low thermal expansion rate, preferably AK steel or Invar.

According to yet another feature of the present invention, the separating cover is mounted simultaneously on the top and bottom of the shadow mask.

According to still yet another feature of the present invention, the separating cover is suitably sized and shaped to fully cover the non-aperture portions while exposing the aperture portion of the shadow mask.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE INVENTION

Figure 4:
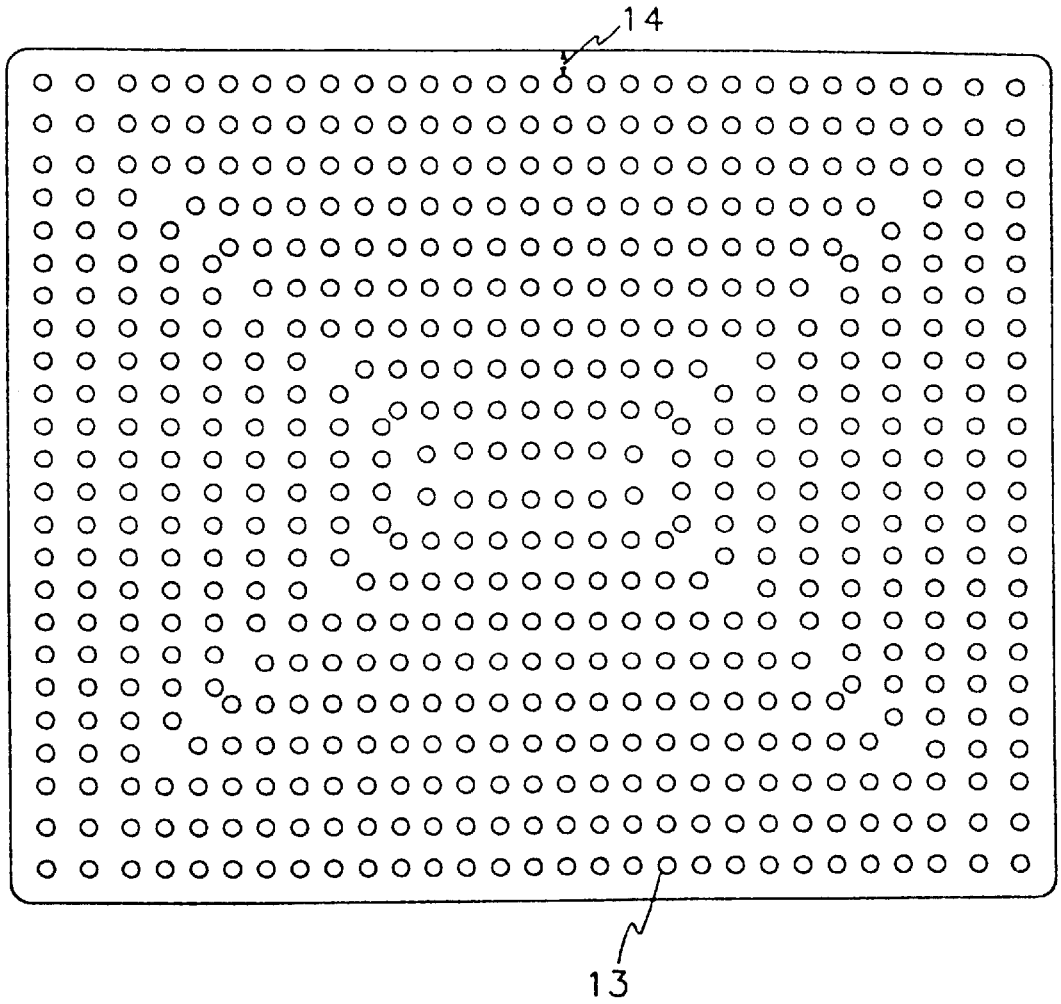
FIG. 4 shows a shadow mask with an aperture portion and a non-aperture portion.

A CRT shadow mask according to the present invention is made of a low thermal expansion material such as AK steel or Invar. As shown in FIG. 4, the shadow mask includes an aperture portion 13 and a periphery or non-aperture portion 14 surrounding the aperture portion. In the inventive shadow mask, only the aperture portion is selectively heat-treated such that the tensional strength of the aperture portion is 1.2 to 3 times greater than that of the non-aperture portion and the modulus of elasticity of the aperture portion is 1.5 to 3 times greater than that of the non-aperture portion.

The selective heat-treating of the aperture portion is performed in a gaseous atmosphere in which at least one of the following is present: an RX gas, a propane gas, an ammonia gas or a gas containing boron. The aperture portion is made of a material containing at least one element selected from the group consisting of carbon, nitrogen and boron. For the above boron gas, it is possible to use $B_2H_6$ or $BCl_3$.

A method of manufacturing the shadow mask of the present invention will now be described in detail hereinafter.

A predetermined number of metallic plates, having a plurality of apertures formed in a predetermined area to form aperture portions, is stacked and loaded on a tray. A separating cover is placed over the top metallic plate. The separating cover is designed to expose aperture portions of the metallic plates while covering peripheries, or non-aperture portions, of the same. After a pre-heating furnace is set to a temperature between 100° C. and 200° C., the tray having the stacked metallic plates thereon is placed in the pre-heating furnace.

Next, the RX gas, propane gas, ammonia gas, and/or gas containing boron is fed into a reacting furnace, which is heated to a temperature over 150° C. When RX gas is used, it comprises of 40% $H_2$, 40% $N_2$ and 20% CO; and the gas containing boron is, as described above, $B_2H_6$ or $BCl_3$. Subsequently, the temperature in the reacting furnace is increased to between 400 and 1000° C., and the gaseous atmosphere therein is suitably maintained, after which the metallic plates in the pre-heating furnace are transferred to the reacting furnace.

The metallic plates are heat-treated in the reacting furnace for between 0.1 and 5 hours. After a predetermined amount of time has elapsed, the temperature in the reacting furnace is reduced to 150° C. while the atmosphere therein is maintained in the present state. When this temperature is reached, the injection of gas into the reacting furnace is stopped. Next, the metallic plates are removed from the reacting furnace, and the separator is decoupled from the metallic plates. The metallic plates are then press-formed into the desired shadow mask shape.

The tensile strengths of the aperture and non-aperture portions of the resulting shadow masks manufactured as described above were measured to be 300–500 Mpa for the aperture portion and 200–300 Mpa for the non-aperture portion. Further, the modulus of elasticity for the aperture portion was 200–400×100 Mpa, and that for the non-aperture portion was 100–300×100 Mpa, for only the tensile strength and modulus of elasticity of the aperture portion are increased as a result of the heat-treating process, while the non-aperture portion is left unaffected. Here, the values for the tensional strength and the modulus of elasticity are merely used to illustrate that the aperture portion has higher values after manufacture using the above method of the present invention, and do not refer to differences and limitations in the properties of the aperture and non-aperture portions.

Figure 1:
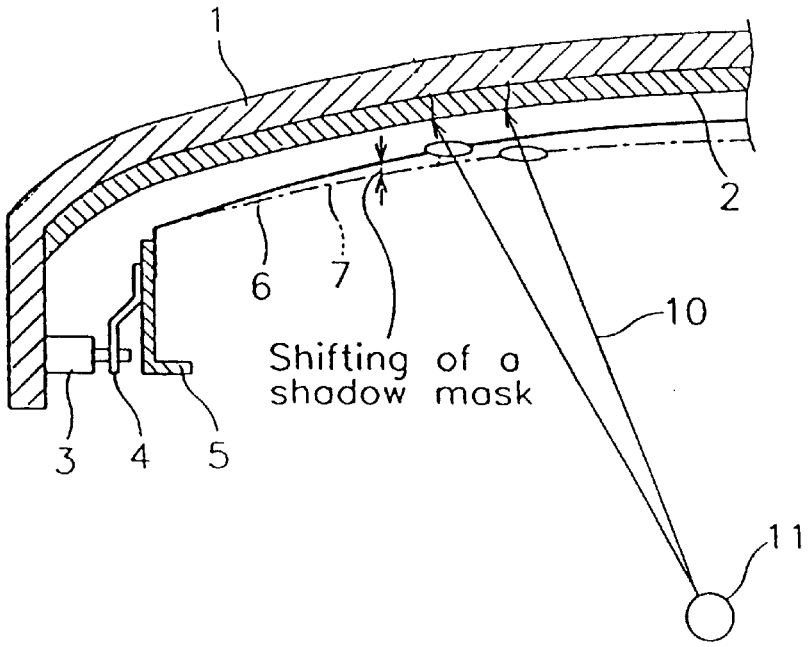
FIG. 1 PRIOR ART
FIG. 1 is a partial sectional view of a conventional CRT used to describe the shifting of a shadow mask caused by an external shock.
Figure 2:
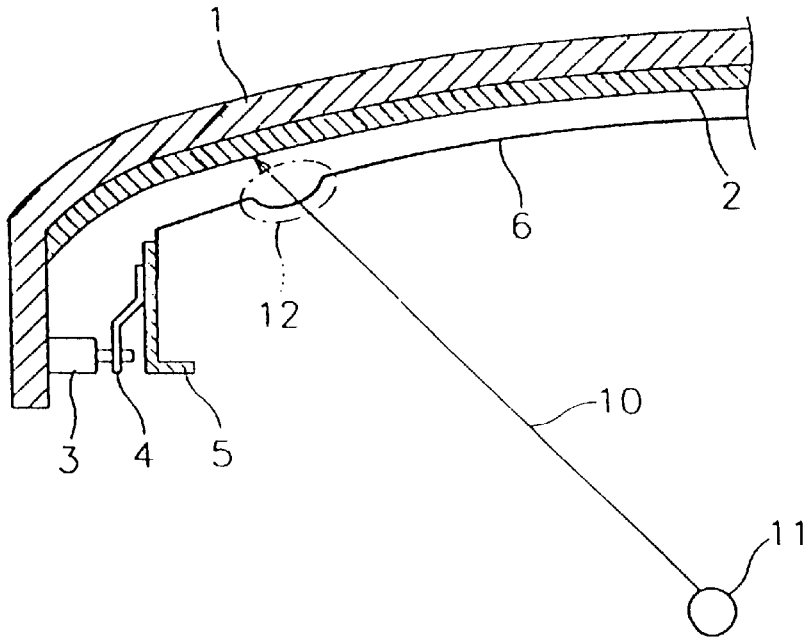
FIG. 2 PRIOR ART
FIG. 2 is a partial sectional view of a conventional CRT used to describe the damage to a shadow mask caused by an extreme external shock.
Figure 3:
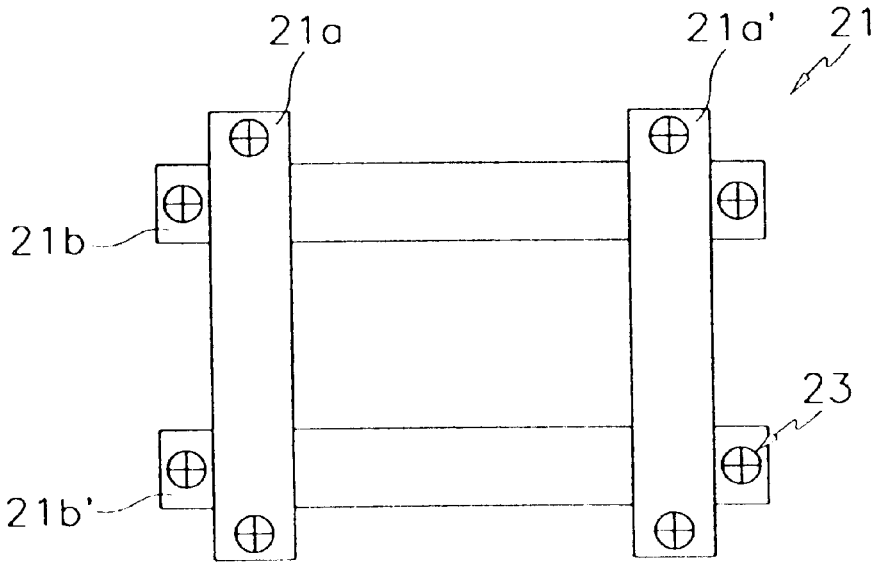
FIG. 3 is a plan schematic view of a separating cover used in a heat-treatment process for manufacturing a shadow mask according to a preferred embodiment of the present invention.

FIG. 3 shows a plan schematic view of a separating cover 21 used in the above heat-treatment process for manufacturing the shadow mask. The present invention is not limited to the separating cover 21 illustrated in FIG. 3, and other configurations can be used as long as they are able to selectively shield the non-aperture portions of the shadow masks from the contact with the gases in the reacting furnace during the heat-treatment process while leaving the aperture portions exposed.

As shown in the drawing, the separating cover 21 comprises a pair of lower straps 21*b*, 21*b*' and a pair of upper straps 21*a*, 21*a*'. The lower straps 21*b* and 21*b*' are substantially parallel and disposed a predetermined distance from each other. Likewise the upper straps 21*a* and 21*a*' are substantially parallel and disposed a predetermined distance from each other. The lower straps 21*b* and 21*b*' are perpendicular to the upper straps 21*a* and 21*a*'. The distances between the lower straps 21*b*, 21*b*' and between the upper straps 21*a*, 21*a*' as well as the widths and lengths of the straps are such that the non-aperture portion, or the area to be formed into the skirt portion, is covered.

In addition, formed on ends of each of the straps 21*a*, 21*a*', 21*b* and 21*b*' are connecting holes 23 which are used to couple the separating cover 21 to the tray after being placed over the stacked metallic plates. Accordingly, with the separating cover 21 mounted over the non-aperture portions of the metallic plates, the non-aperture portions of the metallic plates do not come into contact with the gaseous atmosphere such that this area is not altered by the heat-treatment process. As the result the modulus of elasticity of the non-aperture or skirt portion of the metallic plates remains the same so that there is no springing-back of the skirt portion after it is bent during the press. The gaseous atmosphere can include an RX gas, a propane gas, an ammonia gas and/or a gas containing boron. Also, for the boron gas, it is possible to use $B_2H_6$ or $BCl_3$.

With the use of the separating cover of the present invention shown in FIG. 3, the atoms of the gases used in the heating process are prevented from physically contacting the non-aperture portion of the metallic plate used to manufacture the shadow mask. Hence, the non-aperture or skirt portion of the shadow mask retains its modulus of elasticity even after the heating process, thereby preventing the spring back phenomenon of this area.

EXAMPLE 1

A predetermined number of metallic plates, having a plurality of apertures formed over a predetermined area to form aperture portions, were stacked and loaded on a tray. An inventive separating cover was mounted on the uppermost metallic plate of the stack. Next, a pre-heating furnace was set and maintained at 150° C., after which the tray having the stacked metallic plates thereon was placed in the pre-heating furnace.

Next, RX gas, propane gas, ammonia gas, and/or gas containing boron was fed into a reacting furnace heated to a temperature over 150° C. When RX gas was used, it comprised 40% $H_2$, 40% $N_2$ and 20% CO. Subsequently, the temperature in the reacting furnace was increased to 600° C., and the gaseous atmosphere therein was suitably maintained, after which the metallic plates in the preheating furnace were transferred to the reacting furnace.

The metallic plates were left to stand in the heated reacting furnace for 1 hour. After 1 hour, the temperature in the reacting furnace was reduced to 150° C. while the atmosphere in the same was maintained in the present state. When this temperature was reached, the injection of gas into the reacting furnace was discontinued. Next, the metallic plates were removed from the reacting furnace, and the separating cover was decoupled from the metallic plates. The metallic plates were then press formed into the desired shadow mask shape.

In the shadow mask manufactured using the method of the present invention, since only the aperture portion is exposed to the gaseous atmosphere during the heat-treatment process, whereas the non-aperture or skirt portion is blocked from contact with the gaseous atmosphere, the tensional strength and modulus of elasticity of the aperture portion are increased while the skirt portion is left unaffected. As a result, springing back of the skirt portion during press-forming is prevented.

Although the present invention has been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A shadow mask for a CRT comprising:

an aperture portion having a plurality of apertures formed therein, the aperture portion being formed over a predetermined area in a center of the shadow mask; and a non-aperture portion, adjacent to the aperture portion, defining a periphery of the shadow mask, wherein the aperture portion has a tensile strength 1.2 to 3 times greater than that of the non-aperture portion and a modulus of elasticity 1.5 to 3 times greater than that of the non-aperture portion.

* * * * *